US010371110B2

(12) United States Patent
Brown et al.

(10) Patent No.: US 10,371,110 B2
(45) Date of Patent: Aug. 6, 2019

(54) FUEL INJECTOR HAVING PARTICULATE-BLOCKING PERFORATION ARRAY

(71) Applicant: Caterpillar Inc., Peoria, IL (US)

(72) Inventors: Aaron Michael Brown, Peoria, IL (US); Michael Edward Pickell, Washington, IL (US)

(73) Assignee: Caterpillar Inc., Deerfield, IL (US)

( * ) Notice: Subject to any disclaimer, the term of this patent is extended or adjusted under 35 U.S.C. 154(b) by 29 days.

(21) Appl. No.: 15/849,906

(22) Filed: Dec. 21, 2017

(65) Prior Publication Data

US 2019/0195181 A1 Jun. 27, 2019

(51) Int. Cl.
*F02M 61/16* (2006.01)
*F02F 1/24* (2006.01)
*F02M 61/18* (2006.01)

(52) U.S. Cl.
CPC ..... *F02M 61/165* (2013.01); *F02F 1/242* (2013.01); *F02M 61/1833* (2013.01)

(58) Field of Classification Search
CPC .... F02M 61/165; F02M 61/1833; F02F 1/242
See application file for complete search history.

(56) References Cited

U.S. PATENT DOCUMENTS 4,384,557 A * 5/1983 Johnson ..... F02M 55/02 123/195 C
5,772,123 A * 6/1998 Augustin ..... F02M 37/22 239/533.2
6,234,404 B1 * 5/2001 Cooke ..... F02M 47/00 239/533.9
6,420,817 B1 * 7/2002 Ricci-Ottati ..... F02D 41/2096 123/498
6,446,885 B1 9/2002 Sims, Jr. et al.
8,677,980 B1 * 3/2014 Mucciacciaro .... F02M 37/0064 123/1 A
2003/0217726 A1 * 11/2003 Kennedy ..... F02M 55/02 123/198 D
2004/0069704 A1 4/2004 Yamaguchi et al.
2005/0178861 A1 * 8/2005 Sugiyama ..... F02M 51/0682 239/585.1
2005/0199745 A1 * 9/2005 Berlemont ..... F02M 51/005 239/88
2008/0000219 A1 * 1/2008 Ratcliff ..... F01N 3/0253 60/274

(Continued)

FOREIGN PATENT DOCUMENTS

DE 102010042275 A1 4/2012
WO 2006018440 A1 2/2006

(Continued)

*Primary Examiner* — Joseph J Dallo
(74) *Attorney, Agent, or Firm* — Jonathan F. Yates

(57) ABSTRACT

An engine head assembly includes a plurality of fuel injectors each positioned within a fuel injector bore in an engine head, and fluidly coupled with a fluid conduit. Each fuel injector includes a valve assembly within a fuel injector case such that an interior fluid space is formed between the fuel injector case and the valve assembly. The fuel injector case includes an elongate body having a particulate-blocking perforation array formed therein, and that is structured to block particulates in fuel entering the fuel injector from the fluid conduit.

20 Claims, 5 Drawing Sheets

(56) References Cited

U.S. PATENT DOCUMENTS

| | | | | |
|---|---|---|---|---|
| 2009/0095257 | A1* | 4/2009 | Buchhauser ..... | F02M 55/025<br>123/445 |
| 2009/0120869 | A1 | 5/2009 | Harkema et al. | |
| 2009/0121049 | A1 | 5/2009 | Flynn et al. | |
| 2015/0008271 | A1* | 1/2015 | Mack ..... | F02M 47/027<br>239/575 |
| 2018/0291853 | A1* | 10/2018 | Nair ..... | F02M 61/165 |

FOREIGN PATENT DOCUMENTS

| | | | |
|---|---|---|---|
| WO | 2006049598 | A1 | 5/2006 |
| WO | 2008046678 | A1 | 4/2008 |
| WO | 2017103204 | A1 | 6/2017 |

* cited by examiner

FUEL INJECTOR HAVING PARTICULATE-BLOCKING PERFORATION ARRAY

TECHNICAL FIELD

The present disclosure relates generally to fuel injectors and, more particularly, to a perforated fuel injector case forming an integrated particulate filter.

BACKGROUND

A wide variety of fuel systems for internal combustion engines are well known and widely used, with most modern fuel systems including a fuel injector for delivering metered quantities of a fuel to a combustion chamber. Over the past century, an almost innumerable variety of fuel injector designs have been developed responsive to various operating parameters and operating conditions in an effort to optimize engine performance and operation in one or more ways. Even today, innovation in this field remains robust as efforts to reduce emissions, amongst others, has given rise to new engineering challenges that have been the focus of much inventive effort. For example, the desire to reduce emissions has led to more precisely engineered fuel injectors designed to deliver consistent, accurate quantities of fuel in an effort to achieve cleaner, more reliable, and more complete combustion reactions.

In recent years, engineers have discovered that relatively high fuel injection pressures, and rapid, yet highly precise movement and/or positioning of fuel injector components can offer various advantages relating to emissions composition, efficiency, and other engine operating and performance parameters. Various efforts to reduce emissions and/or to increase performance have also contributed to relatively high operating temperatures within the fuel injectors. To operate optimally under relatively harsh conditions such as high temperatures, fuel injector components are often machined to tight tolerances. Excess heat is known to cause dimensional instability of the fuel injectors, potentially resulting in unreliable injector performance, and can additionally result in varnishing, lacquering, or other problems which typically has an adverse effect on injector performance as well.

One common strategy for addressing the problem of high operating temperatures involves delivering a cooling fluid, such as fuel, to the fuel injector such that some of the heat energy generated by the fuel injector is transferred to the cooling fluid. Such strategies may cause or increase the potential for fuel to become contaminated with particulates, which can cause obstruction of nozzle outlets in the injector, cause wear at the close tolerances of the injector components, or otherwise damage the injector or result in unacceptable injector performance.

Various strategies have been proposed for protecting fuel injector components from potentially contaminating particulates. Most of these strategies involve adding a filter to, or upstream of, the fuel injector. For example, U.S. Pat. No. 6,446,885 to Sims et al. ("Sims") discloses a secondary filter assembly for a fuel injector. The filter in Sims is mounted on a needle valve assembly within the fuel injector, with the filter having a number of holes configured to arrest particulates of a certain size. While this and other strategies prevent contamination under certain conditions, there remains ample room for improvement and development of alternative strategies.

SUMMARY OF THE INVENTION

In one aspect, a fuel injector case includes an elongate body defining a longitudinal axis and has a first axial end and a second axial end. The elongate body further includes an inner peripheral surface and an outer peripheral surface each extending between the first axial end and the second axial end. The elongate body further has a nozzle end segment that includes the first axial end, a second end segment that includes the second axial end, and a filtration segment positioned axially between the nozzle end segment and the second end segment. The filtration segment has a particulate-blocking perforation array with a circumferential distribution of perforations and an axial distribution of perforations in the elongate body, and forming a fluid flow path from the outer peripheral surface to the inner peripheral surface to fluidly connect an interior fluid space within the elongate body to a fluid conduit formed between the elongate body and an engine head.

In another aspect, a fuel injector includes a valve assembly having an electrical actuator and a valve movable in response to a change to an energy state of the electrical actuator, a nozzle piece defining a nozzle outlet, a fuel injector case having an elongate body defining a longitudinal axis, and an interior fluid space formed in part by the elongate body and in part by the valve assembly. The elongate body includes a nozzle segment having the nozzle piece positioned at least partially therein, and a filtration segment having the valve assembly positioned at least partially therein. The filtration segment includes a particulate-blocking perforation array having a circumferential distribution of perforations and an axial distribution of perforations in the elongate body, and forming a fluid flow path to the interior fluid space to fluidly connect the interior fluid space to a fluid conduit formed between the elongate body and an engine head.

In still another aspect, an engine head assembly includes an engine head, a fluid conduit formed in the engine head, and a plurality of fuel injectors each including a valve assembly, a nozzle piece defining a nozzle outlet, and a fuel injector case that includes a particulate-blocking perforation array, each of the valve assemblies and the nozzle pieces being housed in a fuel injector case. Each of the particulate-blocking perforation arrays form a fluid flow path from the fluid conduit into the corresponding elongate body for supplying a filtered flow of a cooling fluid to the corresponding one of the valve assemblies.

DETAILED DESCRIPTION

Figure 1:
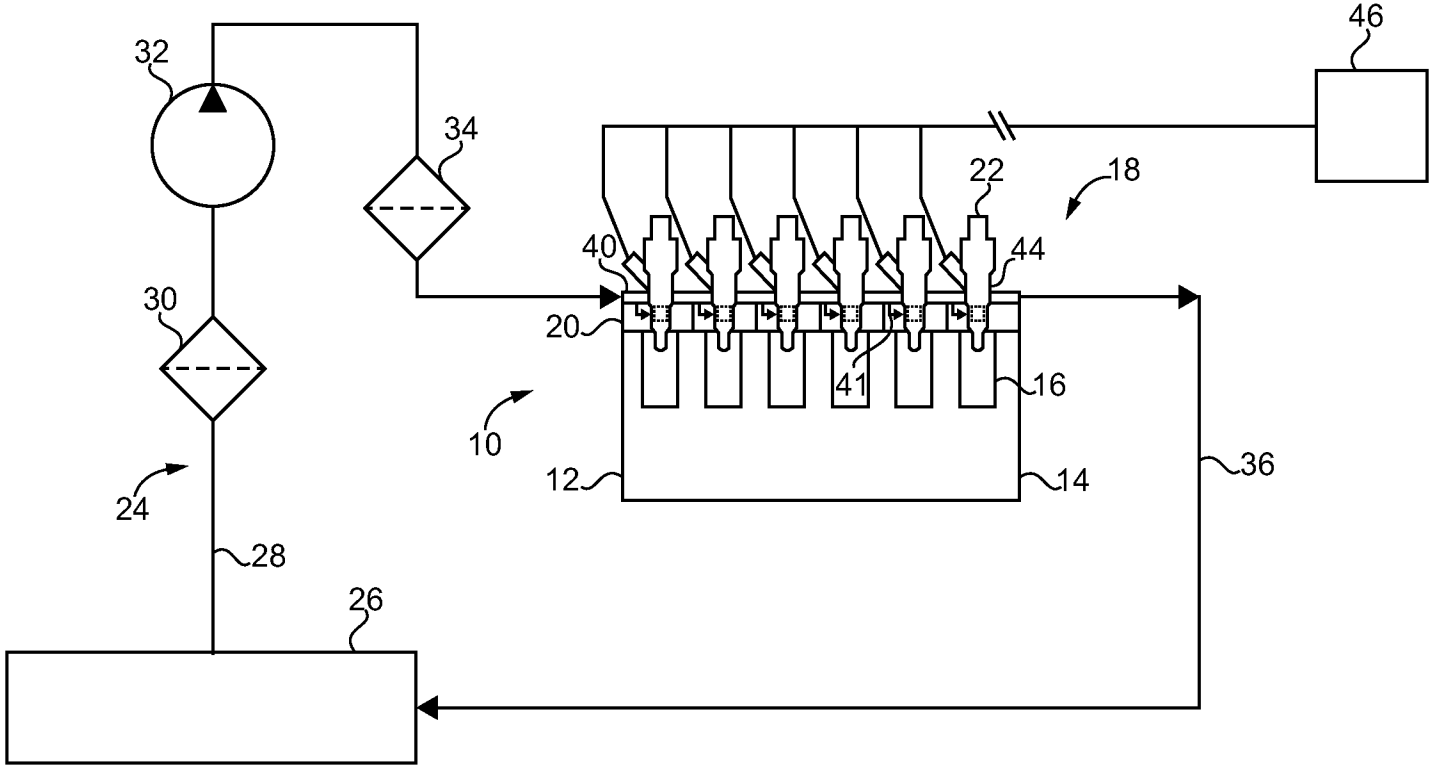
FIG. 1 is a schematic illustration of an engine head assembly that includes a fluid conduit, according to one embodiment.

Referring to FIG. 1, there is shown an engine head assembly 18 for an internal combustion engine ("engine")

10 according to one embodiment. Engine 10 includes an engine housing 12, which includes an engine block 14 defining a plurality of cylinders 16, and an engine head 20. Engine head 20 should be understood to include various and typical valves, air and exhaust conduits, gaskets, seals, and other apparatus of an internal combustion engine. A plurality of pistons (not pictured) are positioned to reciprocate within cylinders 16 in a generally conventional manner. Cylinders 16 may be in-line, include two cylinder banks in a V-configuration, or any other suitable architecture. Engine head assembly 18 includes fueling components such as a fluid conduit 24 that includes an intake line 28 extending from a fuel tank 26 to a first filter 30, a pump 32, and a second filter 34, structured to convey a supply of filtered low-pressure fuel to engine 10. Some segments of fluid conduit 24 may also be at least partially formed within engine head 20 as will be discussed hereinafter. Fluid conduit 24 may also include a drain line 36 to drain fuel from engine 10, and a common fuel passage 40 positioned fluidly between intake line 28 and drain line 36.

Figure 5:
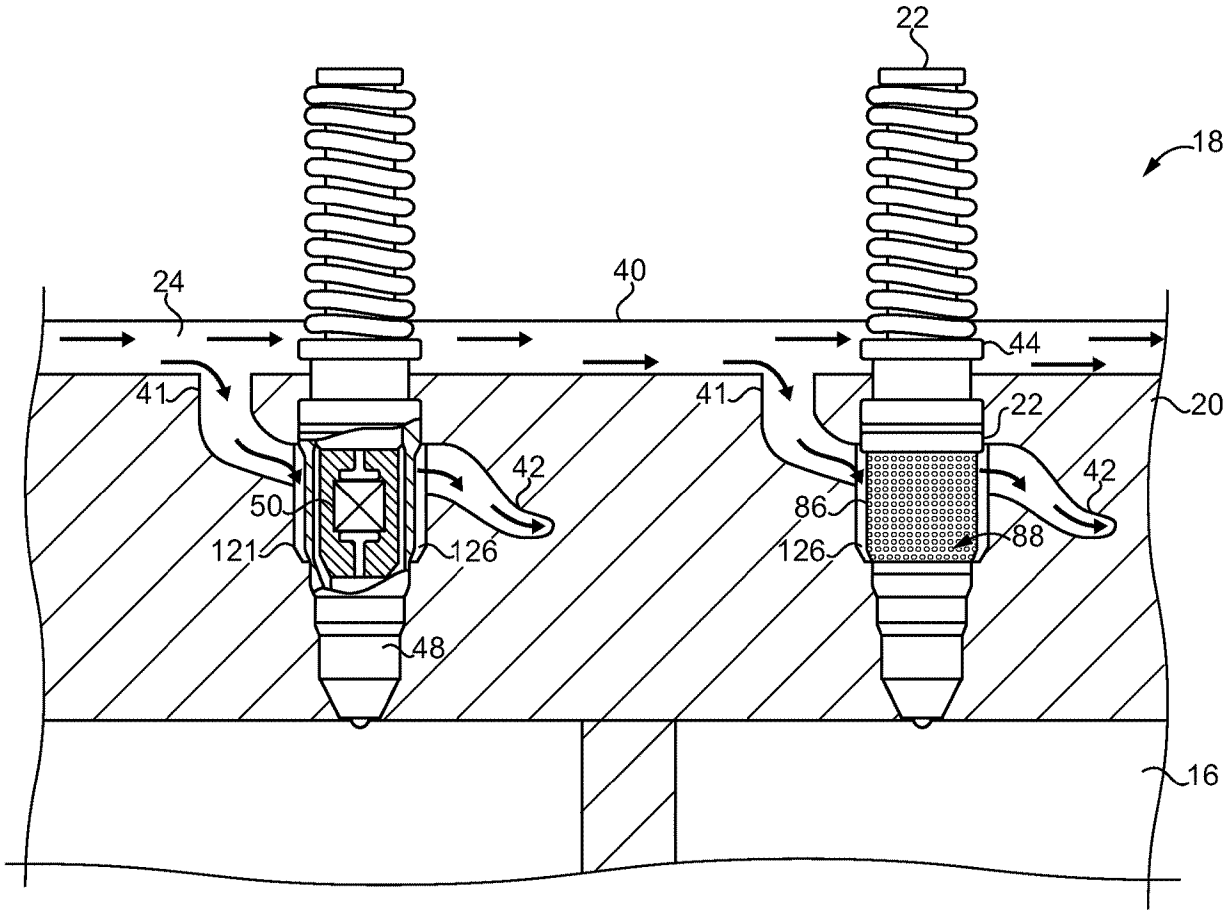
FIG. 5 is a diagrammatic illustration of an engine head, according to one embodiment.

Engine head 20 may include a plurality of fuel injector bores 121 (as illustrated in FIG. 5, discussed hereinafter), and a plurality of fuel injector assemblies 22, each fuel injector assembly 22 being disposed in one of the fuel injector bores 121 such that the corresponding fuel injector assembly 22 extends within the corresponding cylinder 16. Engine head assembly 18 is structured to provide a cooling fluid, such as fuel, to fuel injector assemblies 22 via fluid conduit 24. In other embodiments, a different cooling fluid, such as engine lubricating oil, engine coolant, or still others, may be used. Such embodiments may include different and/or additional structures than those shown. For example, such an embodiment may include a second fluid conduit separate from fluid conduit 24, with each being structured to supply either fuel or the cooling fluid to fuel injector assemblies 22. Fluid conduit 24 may further include a plurality of injector inlet lines 41 and a plurality of injector drain lines 42 (as illustrated in FIG. 5, discussed hereinafter), all of which may be at least partially formed within engine head 20. Each injector inlet line 41 and injector drain line 42 may fluidly couple one fuel injector bore 121 with common fuel passage 40 and drain line 36, respectively, for supplying fuel to or draining fuel from fuel injector assemblies 22.

Figure 2:
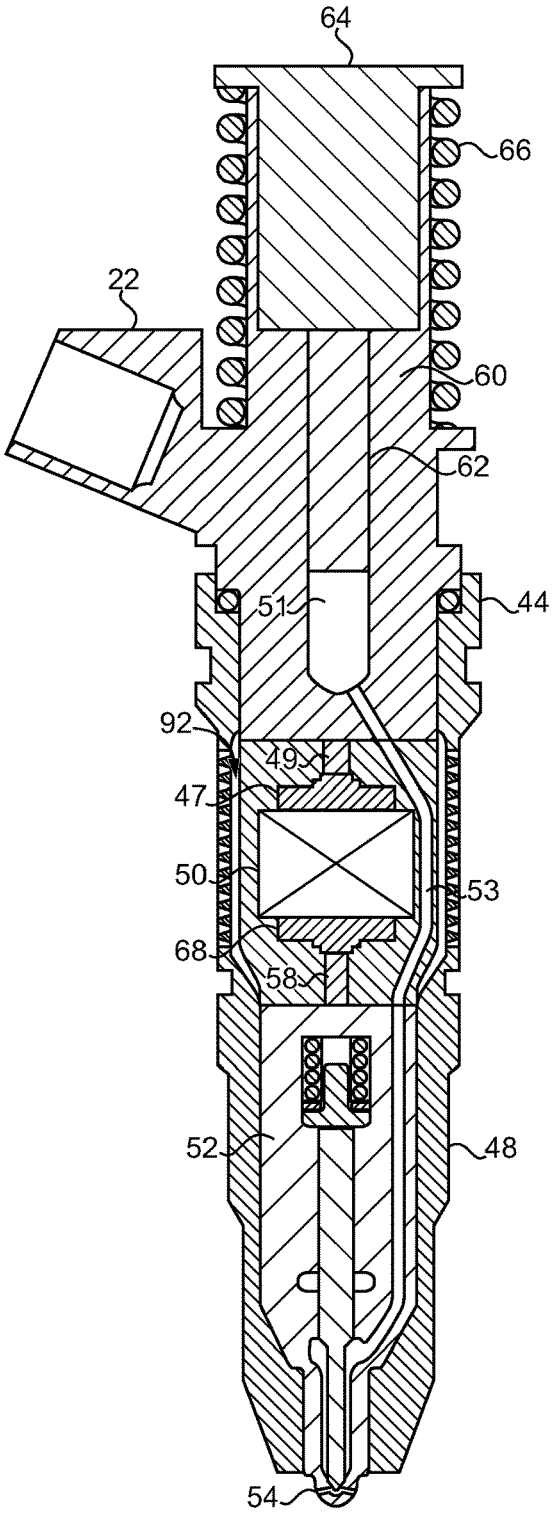
FIG. 2 is a diagrammatic illustration of a fuel injector assembly, according to one embodiment.

Each fuel injector assembly 22 may include a fuel pressurization mechanism 60 (as illustrated in FIG. 2, discussed hereinafter), and a mechanically activated electronic unit injector ("fuel injector") 44 coupled with an electronic control module (ECM) 46. As will be apparent from the discussion herein, fuel within common fuel passage 40 may be supplied to fuel injector assemblies 22 both for cooling components of fuel injector 44 and for injecting into cylinders 16. Fluid conduit 24 may be a low-pressure fuel line for supplying low-pressure fuel to fuel injector assemblies 22 where the fuel can be pressurized by fuel pressurization mechanism 60, although embodiments in which engine head assembly 18 additionally and/or alternatively includes a high-pressure fuel conduit, such as a common rail, a high pressure pump, and other equipment are also contemplated.

Referring now also to FIG. 2, a sectioned diagrammatic view of an exemplary one of the plurality of fuel injector assemblies 22 is shown. Each of the plurality of fuel injector assemblies 22 of the present embodiment may be substantially identical to one another, and therefore the description of fuel injector assembly 22 and the illustration in FIG. 2 should be understood to refer analogously to any of the plurality of fuel injector assemblies 22 in engine head assembly 18. Fuel pressurization mechanism 60 includes a movable plunger 62, a pressure chamber 51 for receiving and pressurizing fuel, and a tappet 64. Tappet 64 is in contact with one of a plurality of cams (not pictured) upon a camshaft (not pictured) rotatable by operation of engine 10 in a generally conventional manner. In this way plunger 62, tappet 64, and a return spring 66 may move in an upward and a downward direction in the orientation of FIG. 2 in response to a rotating action of the cam and the associated camshaft to pressurize fuel in pressure chamber 51. Some embodiments of fuel injector assembly 22 may include different and/or additional components, such as a high-pressure accumulator coupled with one or more of fuel injector assemblies 22 to store a volume of pressurized fuel. In other embodiments, engine head assembly 18 may include a variety of different fuel injectors. For example, such an embodiment may include a fuel injector without fuel pressurization mechanism 60, and may also include a common rail or other high-pressure fuel conduit for delivering pressurized fuel to one or more of the fuel injectors positioned within engine head 20.

Figure 3:
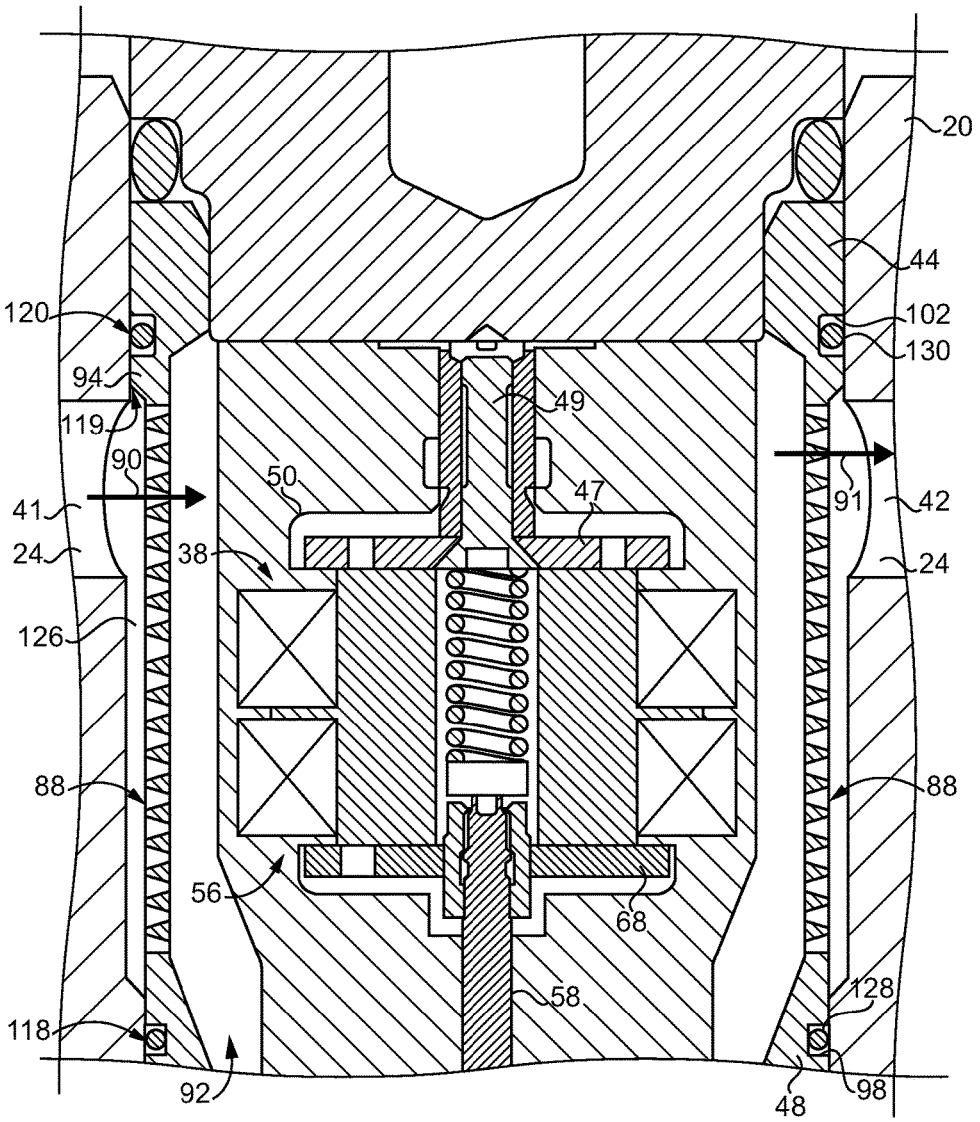
FIG. 3 is a diagrammatic illustration of a fuel injector assembly positioned in an engine head, according to one embodiment.

Each fuel injector 44 includes a valve assembly 50, a nozzle piece 52 defining a nozzle outlet 54, typically a plurality of nozzle outlets, and a fuel injector case 48. Fuel injector case 48 may be sized and shaped to be received at least partially within fuel injector bore 121 such that fuel injector case 48 contacts engine head 20 to form an injector cooling segment 126 (as illustrated in FIGS. 3 & 5, discussed hereinafter) of fluid conduit 24. Valve assembly 50 and nozzle piece 52 and other components may be received within fuel injector case 48 to form a valve stack (not numbered) within fuel injector 44. An internal fuel passage 53 fluidly connects pressure chamber 51 with nozzle outlet 54. Pressure chamber 51 can be selectively connected with fluid conduit 24 through operation of valve assembly 50 in a generally conventional manner, such that an intake stroke of plunger 62 can draw in fuel and a pressurization stroke can deliver fuel to internal fuel passage 53 for injection. It will be appreciated that valve assembly 50 is shown diagrammatically in FIG. 2.

Referring now also to FIG. 3, valve assembly 50 includes a first electrical actuator 38 and a second electrical actuator 56, both of which may include a solenoid. First electrical actuator 38 includes a first armature 47 that is movable in response to a change to an energy state of first electrical actuator 38 for controlling movement of a first valve 49, which may be a spill valve, for instance. Second electrical actuator 56 includes a second armature 68 that is movable in response to a change to an energy state of second electrical actuator 56 for controlling movement of a second valve 58, which, for example, may be an injection control valve. The design and operation of valve assembly 50 can be generally of known strategy, and it should be understood that the precise positioning of internal fuel passage 53 and certain other components of fuel injector assembly 22 could be modified from the illustrated embodiments without departing from the scope of the present disclosure.

Figure 4:
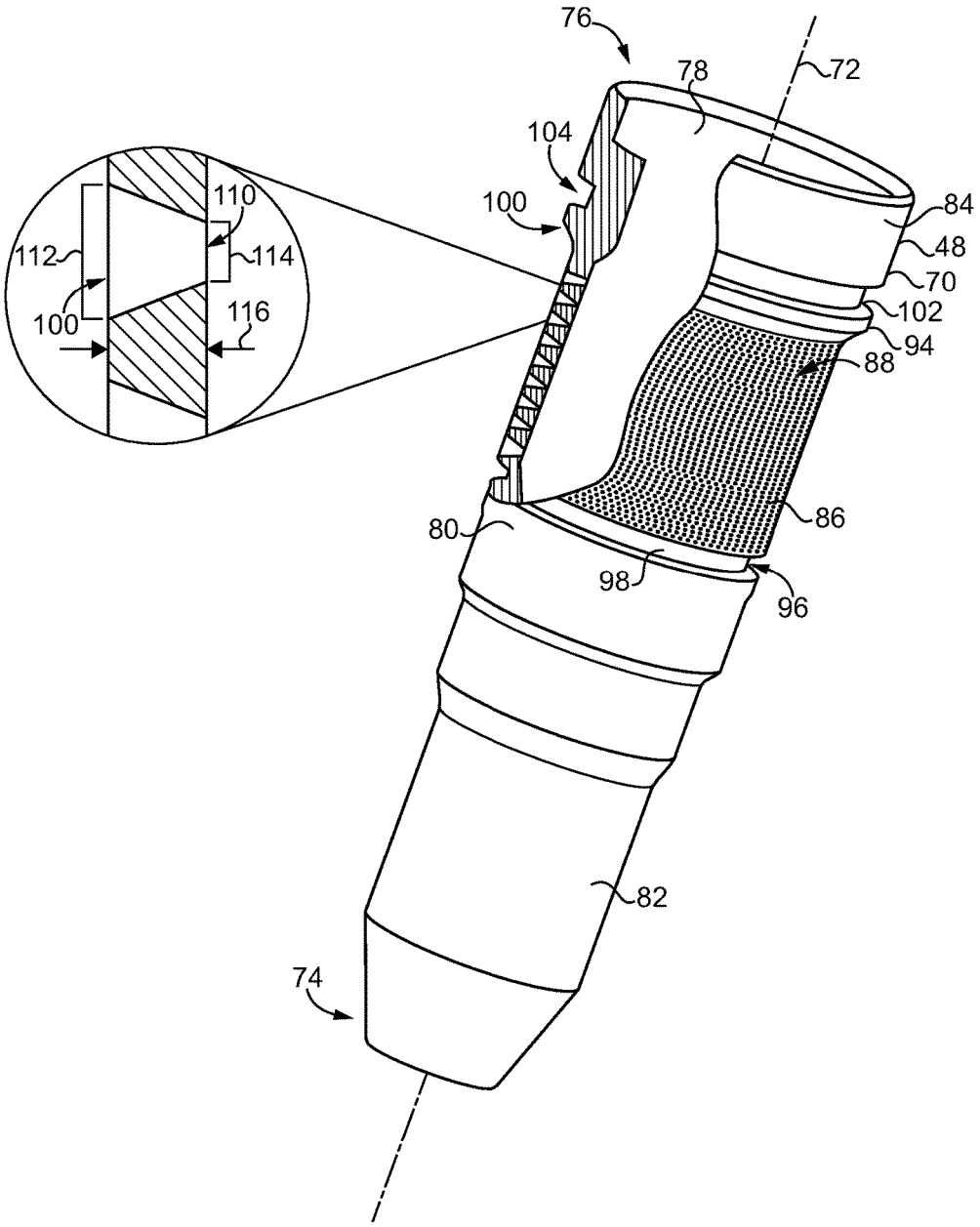
FIG. 4 is a partially sectioned diagrammatic illustration of a fuel injector case, according to one embodiment.

Referring now also to FIG. 4, a partially sectioned diagrammatic view of fuel injector case 48 is shown. Fuel injector case 48 has an elongate body 70 defining a longitudinal axis 72, and includes a first axial end 74 and a second axial end 76. Elongate body 70 also includes an inner peripheral surface 78 and an outer peripheral surface 80 each extending between first axial end 74 and second axial end 76. Additionally, a cylindrical wall 79 may be formed between inner peripheral surface 78 and outer peripheral surface 80. Elongate body 70 further includes a nozzle end segment 82 that includes first axial end 74, a second end segment 84 that includes second axial end 76, and a filtration segment 86 positioned axially between nozzle end segment 82 and second end segment 84. Nozzle end segment 82 may also narrow in a direction of first axial end 74 approximately as shown. Fuel injector case 48 may further include a first annular groove 98 extending around elongate body 70 at a first location 96 axially between filtration segment 86 and nozzle end segment 82, an annular shoulder 94 extending around elongate body 70 at a second location 100 axially between filtration segment 86 and second end segment 84, and a second annular groove 102 extending around elongate body 70 at a third location 104 within second end segment 84.

Filtration segment 86 includes a particulate-blocking perforation array ("perforation array") 88 that has a circumferential distribution of perforations and an axial distribution of perforations in elongate body 70. Put differently, perforation array 88 is made up of a field of perforations formed in elongate body 70 within filtration segment 86. Perforation array 88 can include at least 100,000 perforations formed within filtration segment 86. Embodiments in which perforation array 88 has a different number, extent, distribution, or arrangement of perforations are also contemplated. The number of perforations within perforation array 88 may vary depending on any number of considerations, such as the size and arrangement of the perforations, the size of nozzle outlet 54, the type of cooling fluid utilized, the operating conditions to which fuel injector case 48 is subjected, and many others. For instance, in some embodiments, the number of perforations within perforation array 88 may be calculated to be an amount necessary to achieve a sufficiently large total flow area for perforation array 88. In other embodiments, the number of perforations may be limited only by a dimensional or physical property of fuel injector case 48 such as the surface area of filtration segment 86 or the structural integrity of elongate body 70. Put differently, in some embodiments, elongate body 70 may be perforated until there is no more room for more perforations within filtration segment 86, or until adding more perforations might be considered a risk to the structural integrity of fuel injector case 48. At least a portion of perforation array 88 has a perforation density of about 75 perforations per $mm^2$ or greater. In some embodiments, the perforation density may be substantially uniform throughout filtration segment 86, while other embodiments may have regions that include a relatively higher or relatively lower perforation density than other regions.

Perforation array 88 may have an axial extent that is a majority of an axial length of filtration segment 86, and a circumferential extent that is a majority of a circumference of elongate body 70, within filtration segment 86. A "majority" should be understood to be from about 51% to 100% such that an "entirety" can be understood as a "majority." Both the circumferential distribution of perforations and the axial distribution of perforations may be substantially uniform, although other distributions of perforation array 88 are also contemplated. For example, perforation array 88 may have a band-like distribution within filtration segment 86 where perforation array 88 is formed in multiple bands distributed circumferentially around elongate body 70, and that are axially interspersed with non-perforated regions of filtration segment 86 also extending circumferentially around elongate body 70. Embodiments in which the perforation bands extend only partially around the circumference of elongate body 70 are also contemplated. A similar arrangement may include a series of axially extending perforation columns circumferentially interspersed with non-perforated regions. Still other embodiments could include concentrated distributions of perforations in certain regions of filtration segment 86 that correspond with regions at which fuel injector case 48 is in facing relation to fluid conduit 24 when positioned in engine head assembly 18. In still other embodiments, perforations within perforation array 88 may have a different pattern within filtration segment 86, such as a checkered pattern, a cross-hatched pattern, or any other desired pattern or arrangement consistent with the present disclosure.

FIG. 4 also includes a detailed enlargement of cylindrical wall 79 within filtration segment 86 illustrating an exemplary formation of the perforations through elongate body 70. Laser drilling technology may be used to perforate elongate body 70, and executed such that each perforation within perforation array 88 is substantially identical in size and shape, and substantially free of burrs, for instance, or other non-uniformities. In other embodiments, perforations may have different shapes and/or sizes in different regions of filtration segment 86 than in others. Each perforation in perforation array 88 includes an outer opening 108 formed in outer peripheral surface 80, and an inner opening 110 formed in inner peripheral surface 78. Both outer opening 108 and inner opening 110 may be substantially circular, and each perforation may be substantially conically shaped in that a diameter 112 of each outer opening 108 is greater than a diameter 114 of the corresponding inner opening 110. Accordingly, an area of each outer opening 108 may be greater than an area of the corresponding inner opening 110. In other embodiments, one or both of inner opening 110 and outer opening 108 may be a different shape, though in such embodiments the area of each outer opening 108 can still be greater than the area of the corresponding inner opening 110. In such embodiments, diameter 112 may be understood to be a maximum width of outer opening 108, and diameter 114 may be understood to be a maximum width of inner opening 110. Each diameter 114 within perforation array 88 may be substantially uniform, and may be structured relative to a diameter of nozzle outlet 54 such that perforation array 88 can block particulate matter having a dimension greater than the diameter of nozzle outlet 54. For example, where nozzle outlet 54 has a diameter greater than 100 μm, each diameter 114 may be about 100 μm or less, wherein 1 μm is equal to 0.001 mm. In some contexts, however, it may be desirable to limit diameters 114 to about 75% or less than the diameter of nozzle outlet 54 such that perforation array 88 can block particulate matter having a dimension less than the diameter of nozzle outlet 54. In this context, if the diameter of nozzle outlet 54 is 100 μm, diameters 114 may be, for example, from about 55 μm to about 65 μm. As used herein, the term "about" can be understood in the context of conventional rounding to a consistent number of significant digits. Accordingly, "about 100 μm" can be understood to mean from 51 μm to 149 μm, "about 1.5 mm" can be understood to mean from 1.45 mm to 1.54 mm, and so on.

Each perforation within perforation array 88 extends through elongate body 70 such that a fluid flow path 90 is formed through cylindrical wall 79 from outer peripheral surface 80 to inner peripheral surface 78. A fluid flow path 91 may also be formed through cylindrical wall 79 from inner peripheral surface 78 to outer peripheral surface 80. Cylindrical wall 79 may have a wall thickness 116 from inner peripheral surface 78 to outer peripheral surface 80. Wall thickness 116 may vary based on a number of different operating parameters or other considerations, for instance, a desired flow area, a desired diameter 114, a desired pressure gradient between fluid conduit 24 and an interior fluid space 92, or a desired number of perforations within perforation array 88. Wall thickness 116 within filtration segment 86 of the present embodiments may be from about 0.5 mm to about 1.5 mm. In other embodiments, wall thickness 116 may be from about 1.6 mm to about 2.0 mm, or may be 2.1 mm or greater, though embodiments in which wall thickness 116 may be more or less are also contemplated.

As seen in FIG. 2, nozzle piece 52 and valve assembly 50 may be housed in fuel injector case 48. Nozzle piece 52 is at least partially positioned within nozzle end segment 82, and valve assembly 50 is at least partially positioned within filtration segment 86 such that valve assembly 50 is positioned axially between fuel pressurization mechanism 60 and nozzle piece 52 within fuel injector assembly 22. Fuel injector components such as nozzle piece 52 and valve assembly 50 are positioned in fuel injector case 48 so as to form interior fluid space 92, which may be capable of receiving fuel or other cooling fluids and is formed in part by valve assembly 50 and in part by elongate body 70.

Referring now also to FIG. 5, a diagrammatic view of engine head 20 is shown to illustrate the relative positioning of fuel injector assemblies 22 and fluid conduit 24. Each fuel injector assembly 22 may be positioned in one of the plurality of fuel injector bores 121, with each fuel injector assembly 22 being in fluid communication with common fuel passage 40. In some embodiments, engine head assembly 18 might not include common fuel passage 40. Fluid conduit 24 could instead be partially formed within engine head 20 such that each fuel injector assembly 22 is positioned in a fluid series in that the cooling fluid may flow through fluid conduit 24 to a first one of the plurality of fuel injector assemblies 22, and from the first one to a second one of the plurality of fuel injector assemblies 22, and so on.

Referring now again specifically to FIG. 3, there is illustrated via incoming and outgoing arrows 90 and 91 a flow of fuel through elongate body 70. Fluid conduit 24 may extend to injector cooling segment 126, which is formed between engine head 20 and elongate body 70, and which may fluidly connect perforation array 88, and thus interior fluid space 92, with fluid conduit 24. Injector cooling segment 126 may have an axial extent spanning at least a majority of perforation array 88 and may be annular in shape such that injector cooling segment 126 extends circumferentially around fuel injector case 48 at perforation array 88. A first annular sealing element 128, such as a rubber O-ring or the like, may be positioned in first annular groove 98 to form a first fluid seal 118 between fuel injector case 48 and engine head 20 at first location 96, which may be below perforation array 88 in the orientation of FIG. 4. Annular shoulder 94 may form a second fluid seal 119 between fuel injector case 48 and engine head 20 above perforation array 88. Further, a second annular sealing element 130 may be positioned within second annular groove 102 to form a third fluid seal 120. Fluid seals 118, 119, 120 seal injector cooling segment 126 to prevent fuel from leaking into injector bore 121, thereby confining the flow of fuel through engine head 20 within fluid conduit 24.

Perforation array 88 forms fluid flow path 90 from outer peripheral surface 80 to inner peripheral surface 78 to fluidly connect injector cooling segment 126 with interior fluid space 92 for supplying a filtered flow of fuel to fuel injector assemblies 22. Fluid flow path 90 may carry fuel from injector cooling segment 126 radially inward to interior fluid space 92 so as to fluidly couple fluid conduit 24 with fuel injector 44.

INDUSTRIAL APPLICABILITY

Referring now to the drawings generally, during operation of engine head assembly 18, fuel is pumped through fluid conduit 24 from fuel tank 26 to common fuel passage 40, where fuel may then be conveyed to each of the plurality fuel injector assemblies 22. Valve assembly 50 may be energized such that a metered quantity of fuel is conveyed to the corresponding cylinder 16 through nozzle outlet 54 in a generally conventional manner. As discussed above, high operating temperatures resulting, for instance, from frequent and repetitive energization of valve assembly 50, and from friction created between fuel injector components during use, amongst other things, may reduce the service life of fuel injector assemblies 22, or may otherwise negatively impact performance.

To cool fuel injector 44 during operation, fuel from fuel tank 26 may be delivered to fuel injectors 44. Pump 32 can pump fuel through intake line 28 to and through first filter 30 and second filter 34 to remove particulates from the fuel. Fuel can then be pumped to common fuel passage 40 and supplied to each fuel injector assembly 22 via injector inlet lines 41. Fuel may be permitted to flow into injector cooling segment 126, limited by way of seals 118, 119, 120. From injector cooling segment 126, fuel may pass through elongate body 70 via perforation array 88 along fluid flow path 90 and into interior fluid space 92. Fuel entering interior fluid space 92 may flow circumferentially around valve assembly 50 for cooling, and may be drawn into fuel injector 44 by operation of valve assembly 50 and plunger 62 and be conveyed to pressure chamber 51. Fuel passed through or around fuel injector 22 may then be drained from engine head 20 to fuel tank 26 by drain lines 36, 42.

Though fuel is filtered upstream of common fuel passage 40, it has been observed that servicing or replacing fuel injector assemblies 22, amongst other things, can cause dust, dirt, metal shavings, or other contaminants to be introduced to fluid conduit 24 downstream of filters 30, 34. Wear of parts and surfaces, or still other phenomena, can also produce particulates. Without a filtering mechanism positioned fluidly between fluid conduit 24 and fuel injector case 48, contaminates in fluid conduit 24 downstream of filters 30, 34 may be drawn in to fuel injector 44 for pressurization and injection, potentially resulting in fuel injectors 44 becoming clogged, damaged, or otherwise degraded.

Traditional fuel filtration strategies to combat downstream contamination generally involve positioning additional filters in the fluid conduit between low-pressure filters 30, 34 and injector bores 121, or otherwise positioning a fuel filter on or around fuel injector case 48 or the fuel injector components, such as valves 49, 58. Space limitations, structural concerns, servicing costs, or still other issues can prevent the implementation of these filtering strategies or make them expensive.

Unlike traditional filtering strategies, fuel injector case 48 of the present disclosure includes an integrated fuel filter in the form of perforation array 88. It has been discovered that laser drilling technology enables creation of a field of small perforations within elongate body 70 at filtration segment 86, which can block particulate matter from entering fuel injectors 44 without having to compromise the structural integrity of fuel injector case 48 or install additional filters. Put differently, perforation array 88 can serve as the functional equivalent of a stand-alone filter and is formed within elongate body 70 instead of positioned proximate to fuel injector case 48. In view of the present disclosure, those skilled in the art will recognize the availability of filtering solutions that avoid having to retrofit engine head 20 and/or reengineer fuel injector case 48. For instance, fuel injector assembly 22 may be installed in existing engines without having to modify engine head 20, and may reduce service costs and downtime by allowing the filtering structure (i.e., perforation array 88) to be changed contemporaneously with swapping out fuel injector assembly 22.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. It will be appreciated that certain features and/or properties of the present disclosure, such as relative dimensions or angles, may not be shown to scale. As noted above, the teachings set forth herein are applicable to a variety of different devices, assemblies, and systems having a variety of different structures than those specifically described herein. Other aspects, features and advantages will be apparent upon an examination of the attached drawings and appended claims. As used herein, the articles "a" and "an" are intended to include one or more items, and may be used interchangeably with "at least one." Where only one item is intended, the term "one" or similar language is used. Also, as used herein, the terms "has," "have," "having," or the like are intended to be open-ended terms.

What is claimed is:

1. A fuel injector case comprising:

an elongate body defining a longitudinal axis and including a first axial end and a second axial end, and the elongate body further including an inner peripheral surface and an outer peripheral surface each extending between the first axial end and the second axial end;

the elongate body further having a nozzle end segment that includes the first axial end, a second end segment that includes the second axial end, and a filtration segment positioned axially between the nozzle end segment and the second end segment; and the filtration segment having a particulate-blocking perforation array with a circumferential distribution of perforations and an axial distribution of perforations in the elongate body, and forming a fluid flow path from the outer peripheral surface to the inner peripheral surface to fluidly connect an interior fluid space within the elongate body to a fluid conduit formed between the elongate body and an engine head.

2. The fuel injector case of claim 1 further including an annular groove extending around the elongate body at a first location axially between the filtration segment and the nozzle end segment, and an annular shoulder extending around the elongate body at a second location axially between the filtration segment and the second end segment.

3. The fuel injector case of claim 2 further including a second annular groove extending around the elongate body at a third location in the second end segment, and wherein the nozzle end segment narrows in a direction of the first axial end.

4. The fuel injector case of claim 1 wherein the particulate-blocking perforation array has an axial extent that is a majority of an axial length of the filtration segment, and a circumferential extent that is a majority of a circumference of the elongate body within the filtration segment.

5. The fuel injector case of claim 1 wherein at least a portion of the particulate-blocking perforation array has a perforation density of about 75 perforations per $mm^2$ or greater.

6. The fuel injector case of claim 5 wherein the particulate-blocking perforation array includes at least 100,000 perforations.

7. The fuel injector case of claim 1 wherein each of the perforations includes an outer opening formed in the outer peripheral surface, and an inner opening formed in the inner peripheral surface, and an area of each outer opening is greater than an area of the corresponding inner opening.

8. The fuel injector case of claim 7 wherein a diameter of each of the inner openings is about 100 μm or less.

9. The fuel injector case of claim 8 wherein the diameter of the inner opening is from about 55 μm to about 65 μm.

10. The fuel injector case of claim 1 wherein the filtration segment is substantially cylindrical, and a wall thickness of the elongate body within the filtration segment is from about 0.5 mm to about 1.5 mm.

11. A fuel injector comprising:

a valve assembly having an electrical actuator and a valve movable in response to a change to an energy state of the electrical actuator;

a nozzle piece defining a nozzle outlet;

a fuel injector case having an elongate body defining a longitudinal axis;

the elongate body including a nozzle end segment having the nozzle piece positioned at least partially therein, and a filtration segment having the valve assembly positioned at least partially therein;

an interior fluid space formed in part by the elongate body and in part by the valve assembly; and the filtration segment including a particulate-blocking perforation array having a circumferential distribution of perforations and an axial distribution of perforations in the elongate body, and forming a fluid flow path to the interior fluid space to fluidly connect the interior fluid space to a fluid conduit formed between the elongate body and an engine head in an internal combustion engine.

12. The fuel injector of claim 11 wherein each perforation includes an outer opening formed in an outer peripheral surface of the elongate body, and an inner opening formed in an inner peripheral surface of the elongate body, and an area of the outer opening is greater than an area of the corresponding inner opening.

13. The fuel injector of claim 12 wherein the inner openings have a diameter from about 55 μm to about 65 μm.

14. The fuel injector of claim 12 including a nozzle outlet formed in the nozzle piece, wherein the inner openings have a diameter about 75% or less than of a diameter of the nozzle outlet.

15. The fuel injector of claim 11 wherein the elongate body includes an inner peripheral surface, an outer peripheral surface, and a cylindrical wall between the inner peripheral surface and the outer peripheral surface having a wall thickness within the filtration segment from about 0.5 mm to about 1.5 mm.

16. The fuel injector of claim 11 wherein the particulate-blocking perforation array has an axial extent that is at least a majority of an axial length of the filtration segment.

17. The fuel injector of claim 11 further including a fuel pressurization mechanism having a plunger and a tappet, and wherein the valve assembly is positioned axially between the fuel pressurization mechanism and the nozzle piece.

18. An engine head assembly comprising:

an engine head;

a fluid conduit formed in the engine head;

a plurality of fuel injectors each including a valve assembly, a nozzle piece defining a nozzle outlet, and a fuel injector case that includes a particulate-blocking perforation array, each of the valve assemblies and the nozzle pieces being housed in a fuel injector case; and each of the particulate-blocking perforation arrays forming a fluid flow path from the fluid conduit into the corresponding elongate body for supplying a filtered flow of a cooling fluid to the corresponding one of the valve assemblies.

19. The engine head assembly of claim 18 wherein:

each of the fuel injector cases includes an elongate body defining a longitudinal axis extending between a first axial end and a second axial end, and has an inner peripheral surface, an outer peripheral surface, and a cylindrical wall between the inner peripheral surface and the outer peripheral surface, the cylindrical wall having a wall thickness from about 0.5 mm to about 1.5 mm within the particulate-blocking perforation array;

each of the fuel injector cases further including an annular groove extending around the elongate body at a first location axially between the particulate-blocking perforation array and the first axial end, and an annular sealing element positioned in the annular groove such that the annular sealing element forms a fluid seal with the engine head;

each perforation in the particulate-blocking perforation array having an outer opening formed in the outer peripheral surface, and an inner opening formed in the inner peripheral surface, an area of the outer opening being greater than an area of the corresponding inner opening;

a diameter of each of the plurality of nozzle outlets being less than a diameter of substantially all the inner openings in the particulate-blocking perforation array formed in the corresponding fuel injector case; and each of the particulate-blocking perforation arrays including at least 100,000 perforations, and the particulate-blocking perforation array having an axial distribution of perforations and a circumferential distribution of perforations.

20. The engine head assembly of claim 19 wherein each of the elongate bodies further includes an annular shoulder extending around the elongate body at a second location axially between the corresponding particulate-blocking perforation array and second axial end, and that forms a second fluid seal with the engine head.

* * * * *